US012588700B2

(12) United States Patent
Sinkinson et al.

(10) Patent No.: US 12,588,700 B2
(45) Date of Patent: Mar. 31, 2026

(54) E-LIQUID COMPOSITION COMPRISING 1,3-PROPANEDIOL BELOW 50% BY WEIGHT OF THE COMPOSITION

(71) Applicant: JT International SA, Geneva (CH)

(72) Inventors: Cécile Sinkinson, Versonnex (FR); Akihiro Kondoh, Geneva (CH)

(73) Assignee: JT International SA, Geneva (CH)

( * ) Notice: Subject to any disclaimer, the term of this patent is extended or adjusted under 35 U.S.C. 154(b) by 663 days.

(21) Appl. No.: 17/781,605

(22) PCT Filed: Dec. 2, 2020

(86) PCT No.: PCT/EP2020/084316

§ 371 (c)(1),
(2) Date: Jun. 1, 2022

(87) PCT Pub. No.: WO2021/110766

PCT Pub. Date: Jun. 10, 2021

(65) Prior Publication Data

US 2023/0000136 A1 Jan. 5, 2023

(30) Foreign Application Priority Data

Dec. 2, 2019 (EP) ..... 19212870

(51) Int. Cl.
*A24B 15/32* (2006.01)
*A24B 15/167* (2020.01)
(Continued)

(52) U.S. Cl.
CPC ..... *A24B 15/32* (2013.01); *A24B 15/167* (2016.11); *A24B 15/302* (2013.01); *A24F 40/10* (2020.01)

(58) Field of Classification Search
None
See application file for complete search history.

(56) References Cited

U.S. PATENT DOCUMENTS

2015/0299484 A1* 10/2015 Lee ..... C09D 11/322 106/31.62
2016/0120225 A1* 5/2016 Mishra ..... A24F 40/46 392/386

(Continued)

FOREIGN PATENT DOCUMENTS

CN 106455675 A 2/2017
CN 106418662 B * 10/2018 ..... A24B 15/16

(Continued)

OTHER PUBLICATIONS

Machine translation of WO 2020239083 A1 (Year: 2024).*

(Continued)

*Primary Examiner* — Michael H. Wilson
*Assistant Examiner* — Tobey C Le
(74) *Attorney, Agent, or Firm* — Lerner David LLP

(57) ABSTRACT

A solvent for aerosol-generating material includes predominantly 1, 3-Propanediol and glycerol, wherein the 1, 3-Propanediol is less than 50% by weight based on the total weight of the solvent. In particular, it is shown also herein that when the ratio of 1, 3-Propanediol to glycerol is 3:7, the solvent significantly improves for example thermal stability as well as decreases inhaled flavours concentrations.

20 Claims, 13 Drawing Sheets

(51) Int. Cl.
*A24B 15/30* (2006.01)
*A24F 40/10* (2020.01)

(56) References Cited

U.S. PATENT DOCUMENTS

| | | | | |
|---|---|---|---|---|
| 2016/0262443 | A1 | 9/2016 | Piccirilli et al. | |
| 2017/0215470 | A1* | 8/2017 | Piccirilli | A61K 31/465 |
| 2019/0116880 | A1 | 4/2019 | Lau et al. | |
| 2020/0077701 | A1* | 3/2020 | Mishra | A24D 1/14 |

FOREIGN PATENT DOCUMENTS

| | | | | |
|---|---|---|---|---|
| CN | 110506978 | A | 11/2019 | |
| WO | 2015092757 | A1 | 6/2015 | |
| WO | 2016005709 | A1 | 1/2016 | |
| WO | 2019211629 | A1 | 11/2019 | |
| WO | WO-2020239083 | A1 * | 12/2020 | A24B 15/167 |

OTHER PUBLICATIONS

Machine translation of CN 106418662 B (Year: 2025).*
Paragraph-ordered machine translation of WO 2020239083 A1 (Year: 2025).*
"Physical and chemical assessment of 1,3 Propanediol as a potential substitute of propylene glycol in refill liquid for electronic cigarettes", Bertrand et al., Nature, https://www.nature.com/articles/s41598-018-29066-6. (Year: 2018).*
International Search Report for Application No. PCT/EP2020/084316 mailed Feb. 17, 2021, pp. 1-4.
Search Report dated Oct. 10, 2022 from the Office Action for Chinese Application No. 202080079951.6 issued Oct. 24, 2022, pp. 1-2.

* cited by examiner

E-LIQUID COMPOSITION COMPRISING 1,3-PROPANEDIOL BELOW 50% BY WEIGHT OF THE COMPOSITION

CROSS-REFERENCE TO RELATED APPLICATIONS

The present application is a national phase entry under 35 U.S.C. § 371 of International Application No. PCT/EP2020/084316, filed Dec. 2, 2020, published in English, which claims priority to European Application No. 19212870.0 filed Dec. 2, 2019, the disclosures of which are incorporated herein by reference.

TECHNICAL FIELD OF THE INVENTION

Present invention relates to the field of electronic cigarette, in particular relates to a solvent capable of generating aerosol and a smoke solution for aerosol-generating material.

BACKGROUND OF THE INVENTION

E-cigarettes, also known as e-cigs, vapes, vape pens, mods and tanks are devices that operate by heating a liquid solution to a high enough temperature so that it produces an aerosol that is inhaled and are considered as alternatives to traditional smoking E-cigarette are devices that produce an aerosol that contains fine chemical particles produced from the liquid solution. The liquid solution, sometimes called e-liquids or solvent, typically includes nicotine, flavourings and a humectant, such as propylene glycol, to retain moisture and create an aerosol when heated.

Many of the flavourings and humectants used in e-liquids have been approved by regulators for oral consumption, however there is lack of research regarding the effects of these compounds when inhaled as an aerosol in the long term. For this reason, the composition of liquid solution for e-cigarettes remain largely unchanged. Thus, there is a need to find alternative composition or alternative formula of the liquid solutions.

SUMMARY OF THE INVENTION

The inventors of the present invention have found solutions to the above-discussed problems through currently proposed solvents, liquids and aerosol-generating articles as defined in the claims.

A first aspect of the invention is accordingly to provide a solvent for aerosol-generating material, wherein the solvent comprises of 1, 3-Propanediol and glycerol (i.e. propane-1, 2, 3-triol), wherein the 1, 3-Propanediol is less than 50% by weight based on the total weight of the solvent.

A second aspect of the invention is accordingly to provide a liquid composition comprising a solvent of the present invention and any of nicotine and/or flavourant and/or water.

A third aspect of the invention is accordingly an aerosol-generating article comprises the liquid composition of the present invention, wherein the composition is provided in form of a gel, a foam or a semi-solid matrix.

A fourth aspect of the invention relates to the use of the solvent or the liquid composition or the aerosol-generating article of the present invention for smoking.

The inventors of the present invention found out that instead of a commonly used e-liquid composition of glycerol and 1, 2-Propanediol, a solvent comprises 1, 3-Propanediol and glycerol, wherein the 1, 3-Propanediol is less than 50% by weight based on the total weight of the solvent. In other words, a combination of predominantly (i.e. over 50% of the total weight of the solvent) of glycerol and 1, 3-Propanediol (PDO), preferably over 90% by total weight of the solvent, is found to be an effective alternative formula for the e-liquid composition. Available experimental data demonstrated (e.g. highest concentration tested, 1800 mg/m$^3$) that 1, 3-Propanediol does not appear to pose a significant hazard via inhalation of either the vapour, aerosol or a vapour/aerosol mixture. Moreover, it is unexpectedly found out that the solvent according to the invention also significantly improves for example thermal stability as well as decrease inhaled flavours concentrations.

Moreover, similar results have also been observed when at least 90%, at least 95% or at least 98% by weight of the solvent comprises a combination of the 1, 3-Propanediol and the glycerol.

The inventors unexpectedly found out that the present invention confers several advantages not observed in PG (cf. experimental data below) in which certain attributes are obtained in tobacco flavour (e.g. overall flavour, caramel, overall flavour aftertaste, overall liking, tobacco, dryness), menthol flavour (e.g. menthol, overall flavour, vapour volume, roasted) or in fruit flavour (e.g. sweet, sweet aftertaste, bitter, coating). In other words, the formula of the solvent and/or liquid composition can therefore be custom-made based on individual needs. In general, the attributes observed in the 30/70 of PDO/VG (and few instances 50/50 of PDO/VG) are mostly sought after and therefore more desirable to be selected for the formulation in the solvent or liquid composition.

In a further aspect, when the inventors of the present invention explore the effects of the 1, 3-Propanediol and propylene glycol in glycerol in different ratios, it is furthermore found out that when the solvent comprises predominantly of 1, 3-Propanediol and glycerol (e.g. over 50%, over 90%, over 95% or over 98% of the total weight of the solvent) and that when the ratio of 1, 3-Propanediol to glycerol is exactly 3:7, a number of advantages of the e-cigarette attributes of the aerosol-generating solvent in respect of flavours were observed such as a higher overall flavour, overall liking, tobacco, caramel, cooling sensation, vapour volume and sweet/strawberry. These advantages obtained in the solvent comprising the ratio of 3:7 of PDO and glycerol (glycerine) will be explained in more detail below.

According to some preferred embodiments, when the ratio of 1, 3-Propanediol to glycerol (PDO:VG) is in the range of between 3:7 and 1:1, a number of attributes which generally are preferred by most consumers are obtained, more so when the ratio of PDO:VG is 3:7 and to some extent also to the ratio of 1:1.

In one embodiment, the ratio of 1, 3-Propanediol to glycerol is in the range of between 3:7 and 4.5:5.5. The inventors found out that apart similar results can be obtained as in the ratio 3:7, nicotine delivery is found to be increased when the solvent comprises 1, 3-Propanediol and glycerol in such ratio.

According to some embodiments, the solvent forms between 52.24 and 99.25% by weight of the composition, or preferably up to 70%, 75%, 80%, 85% or 90% by weight of the composition. The rest may be made up of elements such as tobacco, water, flavourant, gum, binder and etc.

According to some embodiments, the nicotine forms at most 10% by weight based on the total weight of the composition, preferably at most 5% by weight based on the total weight of the composition.

According to some embodiments, the flavourant forms between 0.7% and 20% by weight based on the total weight of the composition, preferably between 15 and 20% by weight based on the total weight of the composition.

According to some embodiments, the water forms at most 10% by weight based on the total weight of the composition, preferably at most 2.5% by weight based on the total weight of the composition.

According to some embodiments, the composition further comprises between 0.04% and 7.76% by weight of one or a mixture of carboxylic acids on the total weight of the composition.

According to some embodiments, the carboxylic acid is at least one acid selected from the list consisting of Benzoic acid, Levulinic acid, D/L-Tartaric acid, Capric acid, Pyruvic acid, Citric acid, Fumaric acid, D/L-Lactic acid, D/L-Malic acid, Sorbic acid, Adipic acid, L-Aspartic acid, L-Glutamic acid, Succinic acid, Gluconic acid, Linoleic acid, Saccharic acid, 3,7 dimethyl-6-octenoic acid, 2-methyl pentanoic acid, trans-2-Hexenoic acid, Caprylic acid, Lauric acid, Stearic acid, Butyric acid, Linolenic acid, Malonic acid, Myristic acid, Oleic acid, Palmitic acid, Phenylacetic acid, Propionic acid, Valeric acid, Decanoic acid, Hexanoic acid, Octanoic acid.

According to some embodiments, the liquid composition has a pH value in the range from 5 to 9, preferably 5.1 to 8.8, more preferably 8.8 to 9.8 when the composition contains no acid, or more preferably pH of 6.3 to 6.5 when the composition contains acid.

According to some embodiments, the article is any of an electronic cigarette, an electronic cigarette cartridge, an e-cigarette liquid.

According to some embodiments, the article is a heat-not-burn consumable product.

In another preferred embodiment, the solvent further comprises one or more of the following components: vapour former, nicotine-containing substrate, water, 1, 2-Propanediol (propylene glycol), flavourings and the combination thereof.

In a further embodiment, the solvent comprises between 0.1% and 2.5% by weight of water based on the total weight of the solvent.

In yet a further embodiment, the solvent comprises between 0.05% and 10% by weight of nicotine-containing substrate based on the total weight of the solvent.

According to one preferred embodiment, the solvent comprises approximately between 0.1% and 11%, preferably at most 10%, more preferably at most 5% by weight of nicotine-containing substrate based on the total of the solvent.

According to another embodiment, the solvent is provided in form of gel-like, foam-like or a semi-solid matrix.

According to one further embodiment, the solvent has a melting point of less than 50° C., preferably less than 35° C., more preferably less than 25° C.

In another embodiment, a minute amount (i.e. less than 2% by weight based on the total solvent weight) of ethanol can further be added in the solvent.

By "about" or "approximately" in relation to a given numerical value, it is meant to include numerical values within 10% of the specified value. In a more restrictive instance, it is meant to be within 5% of the specified value. All values given in the present disclosure are to be understood to be complemented by the word "about", unless it is clear to the contrary from the context.

The indefinite article "a" or "an" does not exclude a plurality, thus should be treated broadly.

Unless defined otherwise, technical and scientific terms used herein have the same meaning as commonly understood by one of ordinary skill in the art to which this invention belongs.

As used herein, the term "aerosol-generating material" refers to a material capable of releasing volatile compounds upon heating, which can form an aerosol. The aerosol generated from the aerosol-generating material of a article described herein may be visible or invisible and may include vapours (for example, fine particles of substances, which are in a gaseous state, that are ordinarily liquid or solid at room temperature) as well as gases and liquid droplets of condensed vapours.

As used herein, wt.-% is to be understood as weight percent, based on the total weight of the solvent, unless explicitly otherwise specified. In the present disclosure, all amounts are given in wt.-%, unless clearly stated otherwise or obvious from context. In the present disclosure, furthermore all amounts given in wt.-% in a particular solvent add up to 100 wt.-%. The weight percent are thereby calculated by dividing the mass of each component by the total mass of the solvent, unless indicated otherwise or clear from context.

As used herein, the term "aerosol-generating article" refers to an article capable of producing an aerosol and comprising an aerosol-generating material that is intended to be heated rather than combusted in order to release volatile compounds that can form an aerosol. The article is any of an electronic cigarette, an electronic cigarette cartridge, an e-cigarette liquid.

The term "solvent" refers to a substance that dissolves another to form a solution. The solvent exists in form of a liquid under room temperature and standard atmosphere pressure.

DETAILED DESCRIPTION OF THE INVENTION

Figure 1:
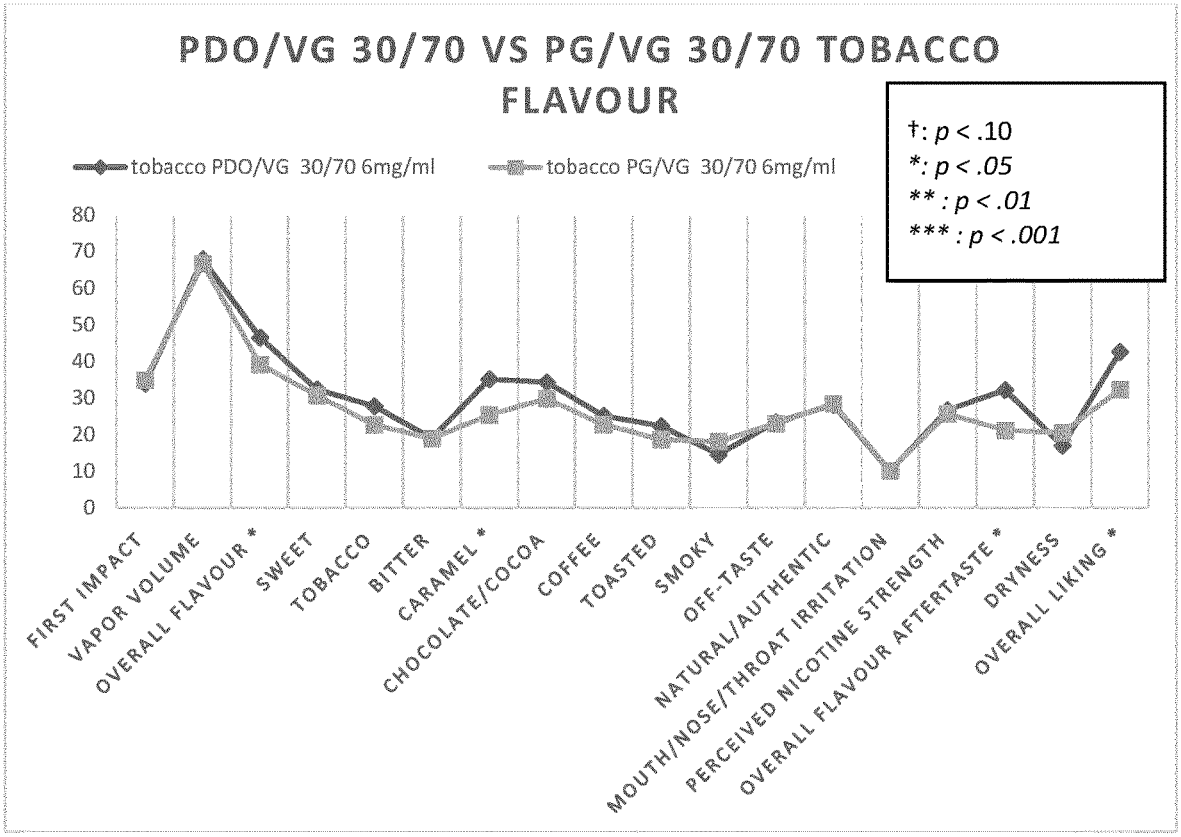
FIG. 1 shows comparison of different attributes in tobacco flavour with PDO/glycerol (VG), or PG/VG under the ratio of 30/70.

The inventors of the present invention have demonstrated that a solvent that comprises 1, 3-Propanediol and glycerol (i.e. Propane-1, 2, 3-triol or also known as glycerine), wherein the 1, 3-Propanediol is less than 50% by weight based on the total weight of the solvent, has a number of advantages compared to the solvent made up of 1, 2-Propanediol and glycerol. These advantages are for instance less stimulating effect on eyes and skin.

Glycols have been used widely in cosmetics and personal care products to impart beneficial properties such as humectancy, solvency, moisturization and emulsification. Propylene glycol (PG) and 1, 3-Propanediol (PDO) are two examples of glycol. PG, or also known as 1, 2-Propanediol, is chemically different to PDO although they have similar structures and physicochemical properties.

Due to its lower boiling point and viscosity, and different solvent properties, propylene glycol (PG) is often mixed with glycerine in liquid blends intended for inhalation. However, in relation to glycerine, the safety profile of propylene glycol is less well established in particular at high concentrations.

Another compound, 1, 3-Propanediol (PDO), which can be manufactured either by a chemical process using petroleum feedstock or by a fermentation (bio-based) process using corn sugar, has been found to be particularly suitable for use in electronic cigarette liquid solutions.

In this connection, the inventors of the present invention found out that PDO is a good alternative for PG in the solvent for use in e-liquid when less than half of the total weight of the solvent comprises the PDO.

Moreover, when the solvent comprises over 90%, over 95% or over 98% by weight of 1, 3-Propanediol and glycerol, it is discovered that in terms of fresh-keeping ability, the required concentration of 1, 3-Propanediol is much lower than that of 1,2-propanediol.

To this end, it is furthermore disclosed herein that apart from the surprising technical effects of the new formulation of solvent for e-cigarettes disclosed herein, the inventors of the present invention further found out that when the solvent comprises predominantly of PDO and glycerol (e.g. over 50%, over 90%, over 95% or over 98% by weight based on total weight), thermal stability of the solvent is improved significantly, with or without nicotine contained therein.

For instance, thermal stability of formulations of nicotine in PG-VG (1, 2-Propanediol and glycerol) and in PDO-VG (1, 3-Propanediol and glycerol) were compared by differential thermal analysis. It was observed that a significant exothermic peak at around 250° C. corresponding to a vaporisation residue of 3 wt. % is characteristic of PG-VG and corresponds to an energy release of 37-38 J/g indicating chemical interactions between PG and VG at high temperature. To the contrary, the PDO-VG formulation has no exothermic peak. This observation leads to indicate the absence of any chemical interaction between PDO and VG.

Moreover, the inventors of the invention further discovers that the thermal behaviour of nicotine-PDO formulation unexpectedly demonstrating a co-vaporization process of nicotine and PDO, confirming the absence of chemical interaction between nicotine and PDO. This result suggests that PDO is particularly adapted to ensure a constant delivery of nicotine during vaping process.

More surprisingly, when the ratio between the PDO and glycerol is provided to be exactly at 3:7, as demonstrated by the experimental data, a number of positive e-cigarette attributes have been observed (i.e. higher mean scores for positive attributes and lower mean scores for negative attributes) compared to the samples where PG and glycerol were provided at the same ratio. These positive results were not observed in other ratios, such as 7:3 and 1:1 of PDO and glycerol.

The most common attributes of e-cigarettes used included those that are flavoured, contain nicotine, and are of tank style. It has been proposed that attributes that warrant further research include characterizing flavours and product features that allow user customization (i.e. mixing different e-liquids and adjusting voltage or temperature settings).

For this reason, the inventors of the present invention have looked into one perspective of the e-cigarette attributes, namely the "flavour" and the results are disclosed herein.

Several solvents according to the present invention having different percentage of combination of the composition have been prepared and tested. The samples were prepared for example as shown in Table 1 below.

TABLE 1

Solvents prepared according to several combinations.

| Examples | Combined PDO and glycerol (3:7) | Nicotine | Acid | Water | Flavour | Total |
|---|---|---|---|---|---|---|
| 1 | 79.95 wt. % | 0.05 wt. % | 0.00 wt. % | 0.00 wt. % | 20.0 wt. % | 100 wt. % |
| 2 | 70.00 wt. % | 10.0 wt. % | 0.00 wt. % | 0.00 wt. % | 20.0 wt. % | 100 wt. % |
| 3 | 79.91 wt. % | 0.05 wt. % | 0.04 wt. % | 0.00 wt. % | 20.0 wt. % | 100 wt. % |
| 4 | 62.24 wt. % | 10.0 wt. % | 7.76 wt. % | 0.00 wt. % | 20.0 wt. % | 100 wt. % |
| 5 | 77.45 wt. % | 0.05 wt. % | 0.00 wt. % | 2.50 wt. % | 20.0 wt. % | 100 wt. % |

TABLE 1-continued

Solvents prepared according to several combinations.

| Examples | Combined PDO and glycerol (3:7) | Nicotine | Acid | Water | Flavour | Total |
|---|---|---|---|---|---|---|
| 6 | 67.50 wt. % | 10.0 wt. % | 0.00 wt. % | 2.50 wt. % | 20.0 wt. % | 100 wt. % |
| 7 | 77.41 wt. % | 0.05 wt. % | 0.04 wt. % | 2.50 wt. % | 20.0 wt. % | 100 wt. % |
| 8 | 59.74 wt. % | 10.00 wt. % | 7.76 wt. % | 2.50 wt. % | 20.0 wt. % | 100 wt. % |

EXAMPLES

The experimental results which will be discussed below is based on the solvent provided according to the Example 5 (for experimental data shown in FIGS. 1 to 6), or according to the Example 7 (for experimental data shown in the FIGS. 7 to 13), as shown in the Table 1 above. To this end, it is disclosed herein that other examples having different percentage of compositions disclosed above also demonstrated similar results as in the Example 5 or 7. The inventors have used three different flavours for each experiment, namely Tobacco flavour, Menthol flavour and Fruit flavour for which the berry has been used.

For each flavour, a "p" value has been calculated for each attribute. The "p" value is a probability value indicating the statistically significance of the test comparing two samples or formulations for a given attribute. The lower the "p" value, the better is the confidence of the difference observed in the results. In other words, it means that the interval of confidence of the difference between both samples or formulations is high. A "p" value less than 0.1 means that the two samples which are under testing are different at 90%, while a "p" value less than 0.05 means that the two samples are different at 95%. A "p" value less than 0.01 means that the two samples are different at 99%, while a "p" value less than 0.001 means that the two samples are different at 99.9%, Definitions of the attributes respect to each flavour used for characterizing the liquid formulation.

TABLE 2

Different attributes in the tobacco flavour.
Tobacco Flavour

| Attribute | Definition |
|---|---|
| First Impact | Measure the feeling you get in the back of your throat and chest when you inhale vapour for the first vape. |
| Vapor Volume | Measure the amount of vapour perceived in the mouth per puff when inhaling and exhaling, from low, which is low volume to high which is high volume. |
| Overall Flavour | Measure of an overall perception of the flavour intensity (of any kind). |
| Sweet | Measure of a sweet flavour associated with confectionary. |
| Tobacco | Measure of flavour associated with Tobacco Leaf. |
| Bitter | Measure of a bitter taste from low to strong. |
| Caramel | Measure of the flavor associated with cooked sugar/honey/syrup with milk. Toffee-like. |
| Chocolate/Cocoa | Measure of the flavor associated with cocoa powder. |
| Coffee | Measure of the flavor of freshly ground coffee. |
| Toasted | Measure of the caramelized, brown notes developed through direct cooking of some foods i.e: bread, nuts . . . etc. |
| Smoky | Smoky burnt, BBQ like taste. |
| Off-Taste | Any kind of unwanted, bad taste perceived. |
| Natural/Authentic | Measure the perceived authenticity and naturalness of the flavor, from Low which is chemical/medicinal/artificial to high which is natural. |
| Mouth/Nose/Throat Irritation | Measure of a prickling, scratching sensation perceived on the lips, tongue our back of the throat. |
| Perceived Nicotine Strength | Perceived level of nicotine in the product. |
| Overall Flavour Aftertaste | Measure of an overall perception of the flavour intensity of any kind. |
| Dryness | Lack of salivation perceived in the mouth (dry-out of tongue). |
| Overall Liking | How much did you enjoy this product? |

TABLE 3

Different attributes in menthol flavour.
Menthol Flavour

| Attribute | Definition |
|---|---|
| First Impact | Measure the feeling you get in the back of your throat and chest when you inhale vapour for the first vape. |

TABLE 3-continued

Different attributes in menthol flavour.
Menthol Flavour

| Attribute | Definition |
|---|---|
| Vapor Volume | Measure the amount of vapour perceived in the mouth per puff when inhaling and exhaling, from low, which is low volume to high which is high volume. |
| Overall Flavour | Measure of an overall perception of the flavour intensity (of any kind). |
| Sweet | Measure of a sweet flavour associated with confectionary. |
| Bitter | Measure of a bitter taste from low to strong. |
| Menthol | Measure of menthol flavour associated with menthol crystals |
| Peppermint | Measure of a peppermint flavour associated with peppermint essence flavour |
| Spearmint | Measure of a spearmint flavour associated with spearmint essence flavour |
| Eucalyptus | Measure of flavour associated with eucalyptus oil |
| Vanilla | Measure of the flavour of Vanillin |
| Creaminess | The amount of creaminess perceived in the mouth |
| Citrus | Measure of the flavour of citrus like yellow lemon, green lemon or lime |
| Smoky | Smoky burnt, BBQ like or fireplace taste |
| Woody | Measure of the aromatics of various woods. E.g: oak, cedar wood, sandalwood, cedrene |
| Coffee | Measure of the flavor of freshly ground coffee |
| Roasted | Measure of the caramelized, brown notes developed through direct cooking of some foods |
| Off-Taste | Any kind of unwanted, bad taste perceived. |
| Natural/Authentic | Measure the perceived authenticity and naturalness of the flavor, from Low which is chemical/medicinal/artificial to high which is natural. |
| Cooling | Degree of cool feeling in mouth when inhaling and exhaling, from low to high |
| Mouth/Nose/Throat Irritation | Measure of a prickling, scratching sensation perceived on the lips, tongue our back of the throat. |
| Impact | Measure the feeling you get in the back of your throat and chest when you inhale vapour after a while |
| Overall Flavour Aftertaste | Measure of an overall perception of the flavour intensity of any kind. |
| Sweet Aftertaste | The amount of sweet taste that remains in the mouth |
| Mint Aftertaste | The amount of spearmint/peppermint taste that remains in the mouth |
| Cooling Aftertaste | Degree of cool feeling in mouth when breathing in and out, from low to high |
| Coating | Amount of fatty film perceived covering mouth and palate. Measure of a fatty film sensation on the tongue and the inside of the mouth |
| Dryness | Lack of salivation perceived in the mouth (dry-out of tongue). |
| Overall Liking | How much did you enjoy this product? |

TABLE 4

Different attributes in fruit flavour.
Fruit Flavour

| Attributes | Definition |
|---|---|
| First Impact | Measure the feeling you get in the back of your throat and chest when you inhale vapour for the first vape. |
| Vapor Volume | Measure the amount of vapour perceived in the mouth per puff when inhaling and exhaling, from low, which is low volume to high which is high volume. |
| Overall Flavour | Measure of an overall perception of the flavour intensity (of any kind). |
| Sweet | Measure of a sweet flavour associated with confectionary. |
| Tobacco | Measure of flavour associated with tobacco leaf |
| Mint/Menthol | Measure of flavour and nose clearing effects of mint/menthol |
| Bitter | Measure of a bitter taste from low to strong. |
| Apple | Measure of apple flavour perceived |
| Pear | Measure of pear flavour perceived |
| Pineapple | Measure of pineapple flavour perceived |
| Coconut | Measure of coconut flavour perceived |
| Raspberry | Measure of the raspberry flavour perceived, reminiscent of raspberry. Fruity and floral, violet like |
| Strawberry | Measure of the strawberry flavour perceived, reminiscent of strawberry candy |
| Mixed Berries | Measure of a mixed berries aftertaste reminiscent of a confectionary mixed berries taste remaining |

TABLE 4-continued

Different attributes in fruit flavour.
Fruit Flavour

| Attributes | Definition |
|---|---|
| Smoky | Smoky burnt, BBQ like or fireplace taste |
| Woody | Measure of the aromatics of various woods. E.g: oak, cedar wood, sandalwood, cedrene |
| Coffee | Measure of the flavor of freshly ground coffee |
| Roasted | Measure of the caramelized, brown notes developed through direct cooking of some foods |
| Off-Taste | Any kind of unwanted, bad taste perceived. |
| Natural/Authentic | Measure the perceived authenticity and naturalness of the flavor, from Low which is chemical/medicinal/artificial to high which is natural. |
| Cooling | Degree of cool feeling in mouth when inhaling and exhaling, from low to high |
| Mouth/Nose/Throat Irritation | Measure of a prickling, scratching sensation perceived on the lips, tongue our back of the throat. |
| Impact | Measure the feeling you get in the back of your throat and chest when you inhale vapour after a while |
| Overall Flavour Aftertaste | Measure of an overall perception of the flavour intensity of any kind. |
| Sweet Aftertaste | The amount of sweet taste that remains in the mouth |
| Mint Aftertaste | The amount of spearmint/peppermint taste that remains in the mouth |
| Cooling Aftertaste | Degree of cool feeling in mouth when breathing in and out, from low to high |
| Coating | Amount of fatty film perceived covering mouth and palate. Measure of a fatty film sensation on the tongue and the inside of the mouth |
| Dryness | Lack of salivation perceived in the mouth (dry-out of tongue). |
| Overall Liking | How much did you enjoy this product? |

To confirm that a given attribute has been improved when PDO is used compared to when PG is used, the perception of that given attribute with PDO should be higher (for positive attributes driving liking) or lower (for negative attributes driving disliking) than the one with PG and the "p" value of that given attribute is within <0.001 to <0.1. In brief, both requirements need to be fulfilled.

Drivers of liking for formulations are for instance vapour volume, overall flavour intensity, sweet taste, tobacco taste, caramel taste, menthol taste, fruit taste while drivers of disliking are for example Bitter, Off-taste, Mouth/Nose/throat scratching, Drying.

Figure 2:
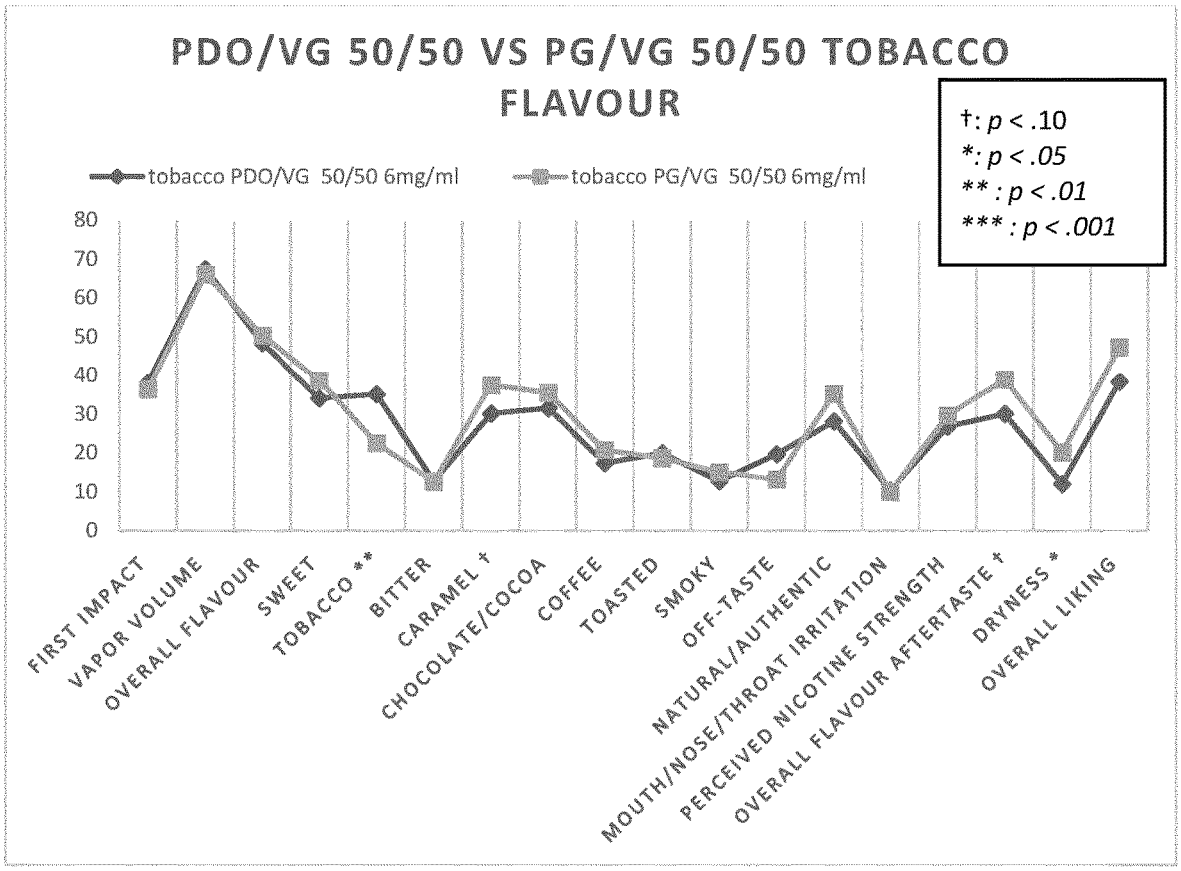
FIG. 2 shows comparison of different attributes in tobacco flavour with PDO/glycerol (VG), or PG/VG under the ratio of 50/50.

FIG. 1 to FIG. 2 show the pairwise comparisons of the attribute mean scores of tobacco flavour between solvents comprising PDO or PG under two different ratios. The perception of each attribute by a panel of testers have been analysed. Surprisingly, the results suggested that when the PDO and glycerol were provided in the ratio 3:7 or 1:1, said solvents were capable of enhancing some specific attributes as described in more details below.

As shown in FIG. 1 as well as Table 5, the sample comprising PG and glycerol provided at the ratio of 30:70 showed significant lower mean scores in comparison to the sample comprising PDO and glycerol in the same ratio for some attributes. In other words, when providing a solvent comprising predominantly of glycerol (i.e. over 50% by weight) and that the ratio between PDO and glycerol was provided at 30:70, such solvent gave a better perception of tobacco flavour in comparison to solvent comprising PG. The PDO 30:70 enhances significantly the perception of tobacco in terms of "overall flavour", "caramel", "overall flavour after taste" and "overall liking" compared to PG/VG 30/70. The p value for each attribute can be seen in the table below. The "p" value is less than 0.05 for each of the attributes "overall Flavour", "Caramel", "Overall Flavour Aftertaste" and "Overall Liking". Therefore, in the allowable range described above in the description. This means that both samples PDO/PG and PG/VG are different at 95% for these attributes.

TABLE 5

P value of pairwise comparison of different attributes in the PDO:VG in the ratio of 30:70.
Tobacco flavour (PDO/VG 30/70 and PG/VG 30/70)

| Attribute | P value |
|---|---|
| First Impact | 0.78 |
| Vapor Volume | 0.68 |
| Overall Flavour * | 0.050 |
| Sweet | 0.75 |
| Tobacco | 0.28 |
| Bitter | 0.99 |
| Caramel * | 0.021 |
| Chocolate/Cocoa | 0.34 |
| Coffee | 0.63 |
| Toasted | 0.33 |
| Smoky | 0.29 |
| Off-Taste | 0.93 |
| Natural/Authentic | 0.94 |
| Mouth/Nose/Throat Irritation | 0.96 |
| Perceived Nicotine Strength | 0.75 |
| Overall Flavour Aftertaste * | 0.039 |
| Dryness | 0.40 |
| Overall Liking * | 0.081 |

Figure 3:
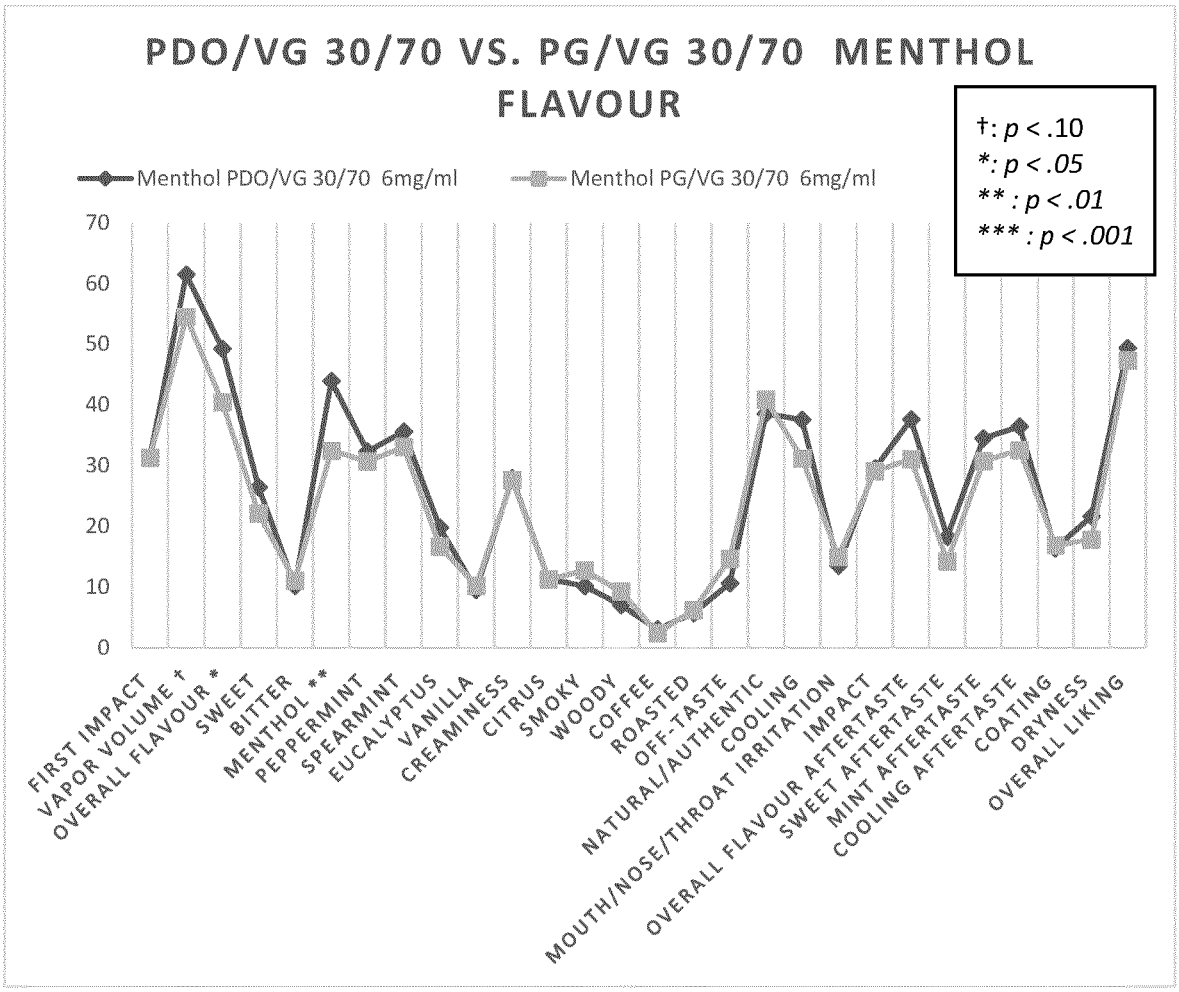
FIG. 3 shows comparison of different attributes in menthol flavour with PDO/glycerol (VG), or PG/VG under the ratio of 30/70.
Figure 4:
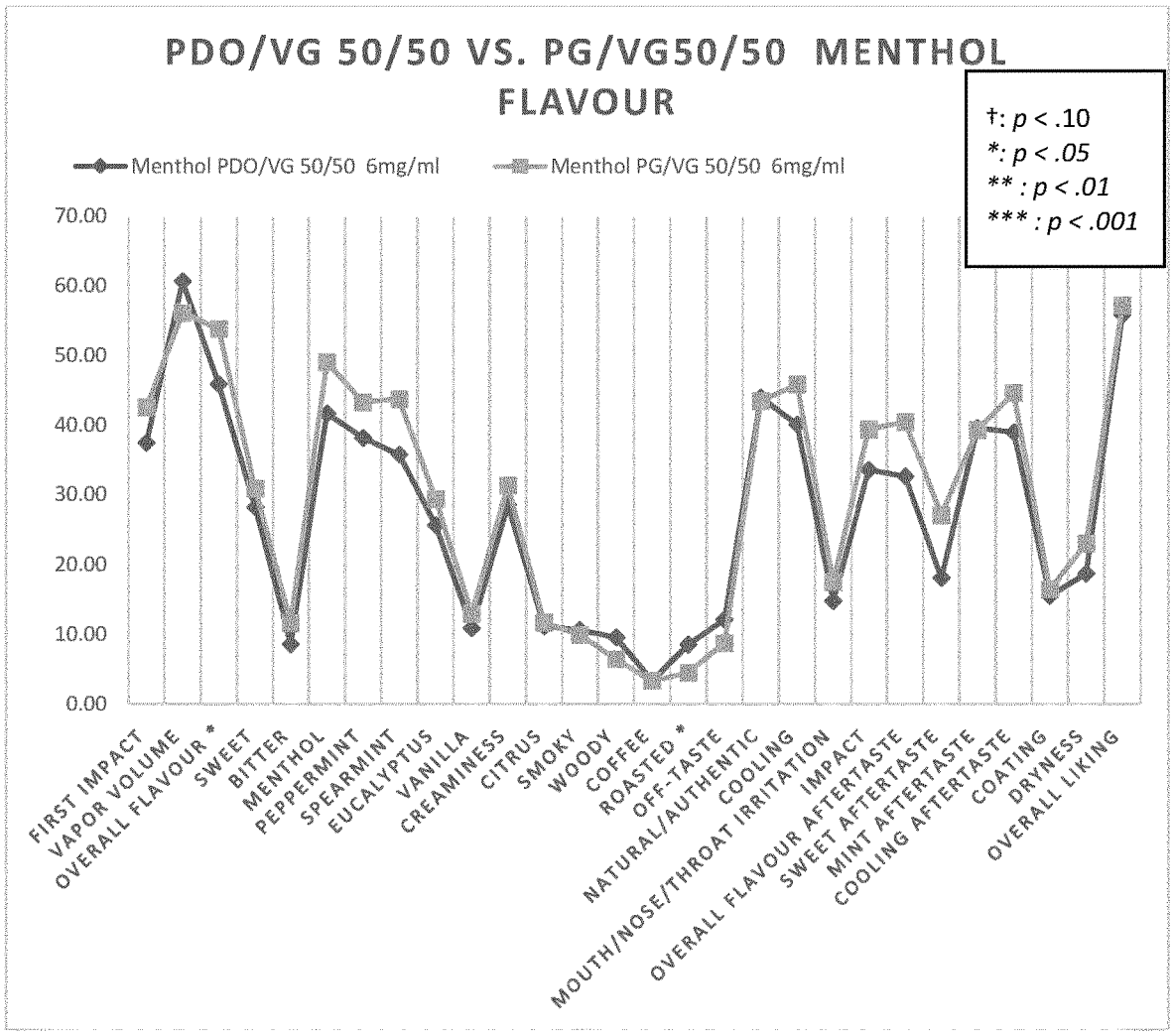
FIG. 4 shows comparison of different attributes in menthol flavour with PDO/glycerol (VG), or PG/VG under the ratio of 50/50.

FIG. 3 and FIG. 4 show the pairwise comparisons of the attribute mean scores of menthol flavour between solvents comprising PDO or PG under two different ratios. The perception of each attribute by a panel of testers have been analysed. Surprisingly, the results suggested that when the PDO and glycerol were provided in the ratio 3:7 or 1:1, said solvents were capable of enhancing some specific attributes as described in more details below.

As shown in FIG. 3 as well as Table 6, the sample comprising PG and glycerol provided at the ratio of 30:70 showed significant lower mean scores in comparison to the sample comprising PDO and glycerol in the same ratio for some attributes. In other words, when providing a solvent comprising predominantly of glycerol (i.e. over 50% by weight) and that the ratio between PDO and glycerol was provided at 30:70, such solvent gave a better perception of menthol flavour in comparison to solvent comprising PG. The PDO 30/70 enhances significantly the perception of Menthol flavour in terms of "Overall Volume", "Menthol" compared to PG/VG 30/70. The "p" value for each attribute can be seen in the table below. In addition, the "p" value is less than 0.10 for the attribute "Vapour Volume", while the "p" value is less than 0.05 for the attribute "Overall Flavour" and less than 0.01 for the attribute "Menthol".

TABLE 6

P value of pairwise comparison of different attributes in the PDO:VG in the ratio of 30:70. Menthol flavour (PDO/VG 30/70 and PG/VG 30/70)

| | |
|---|---|
| First Impact | 0.97 |
| Vapor Volume † | 0.080 |
| Overall Flavour * | 0.023 |
| Sweet | 0.41 |
| Bitter | 0.75 |
| Menthol ** | 0.006 |
| Peppermint | 0.73 |
| Spearmint | 0.62 |
| Eucalyptus | 0.42 |
| Vanilla | 0.79 |
| Creaminess | 0.95 |
| Citrus | 0.98 |
| Smoky | 0.27 |
| Woody | 0.29 |
| Coffee | 0.35 |
| Roasted | 0.81 |
| Off-Taste | 0.27 |
| Natural/Authentic | 0.61 |
| Cooling | 0.12 |
| Mouth/Nose/Throat Irritation | 0.68 |
| Impact | 0.92 |
| Overall Flavour Aftertaste | 0.16 |
| Sweet Aftertaste | 0.38 |
| Mint Aftertaste | 0.36 |
| Cooling Aftertaste | 0.33 |
| Coating | 0.83 |
| Dryness | 0.29 |
| Overall Liking | 0.75 |

Figure 5:
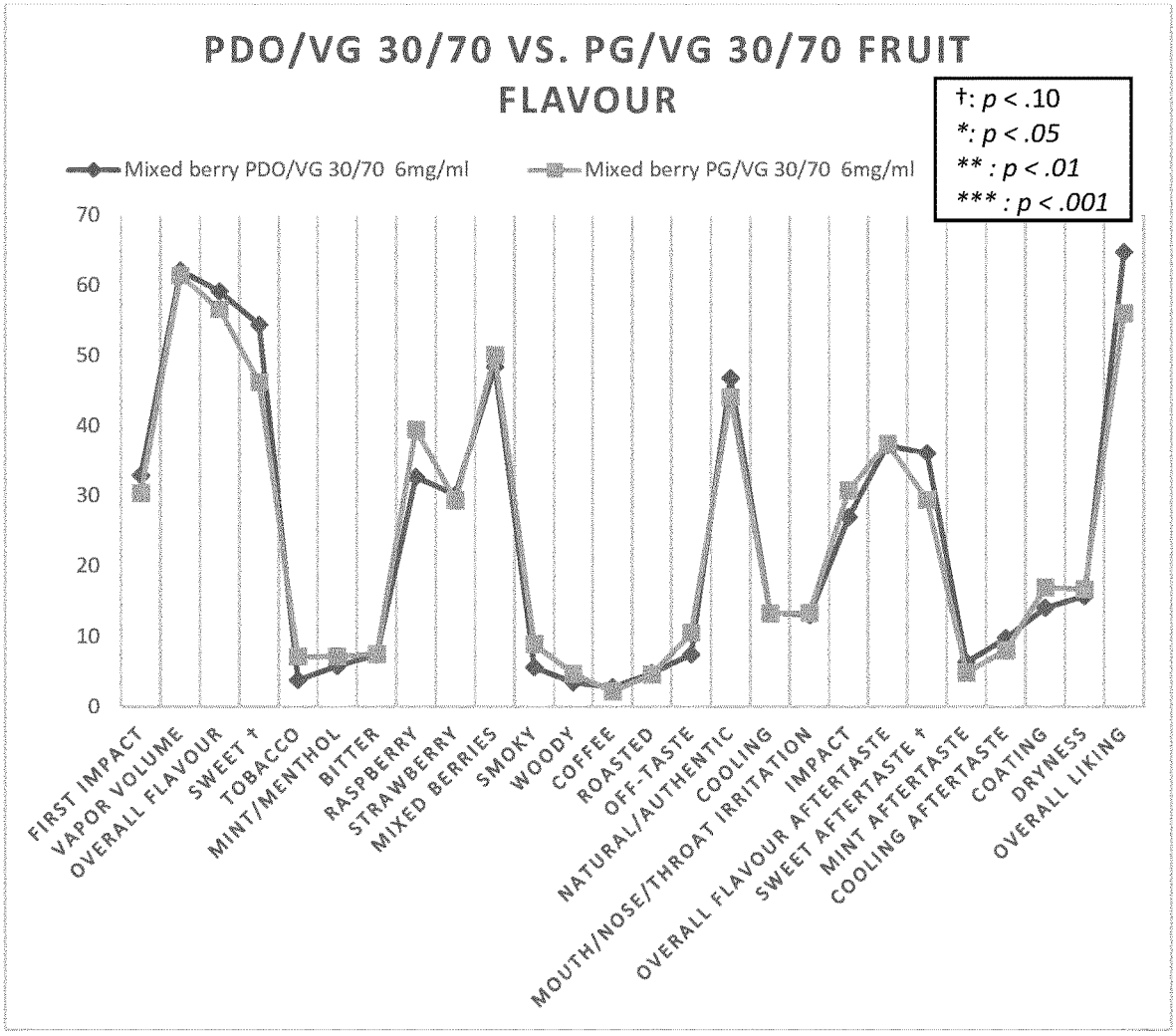
FIG. 5 shows comparison of different attributes in fruit flavour with PDO/glycerol (VG), or PG/VG under the ratio of 30/70.
Figure 6:
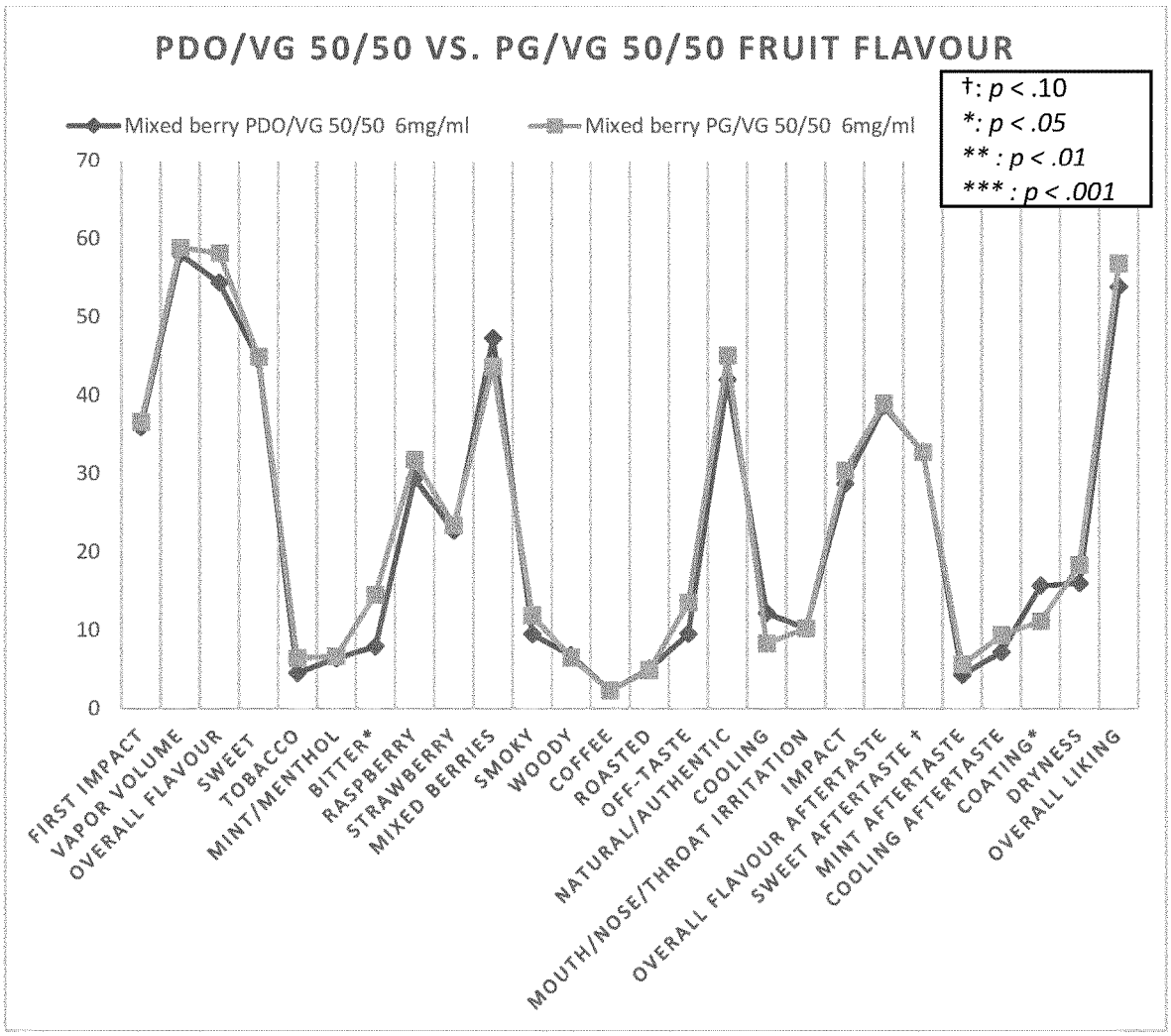
FIG. 6 shows comparison of different attributes in fruit flavour with PDO/glycerol (VG), or PG/VG under the ratio of 50/50.

FIG. 5 and FIG. 6 show the pairwise comparisons of the attribute mean scores of Fruit (berry) flavour between solvents comprising PDO or PG under two different ratios. The perception of each attribute by a panel of testers have been analysed. Surprisingly, the results suggested that when the PDO and glycerol were provided in the ratio 3:7 or 1:1, said solvents were capable of enhancing some specific attributes as described in more details below.

As shown in FIG. 5 as well as Table 7, the sample comprising PG and glycerol provided at the ratio of 30:70 showed significant lower mean scores in comparison to the sample comprising PDO and glycerol in the same ratio for some attributes. In other words, when providing a solvent comprising predominantly of glycerol (i.e. over 50% by weight) and that the ratio between PDO and glycerol was provided at 30:70, such solvent gave a better perception of tobacco flavour in comparison to solvent comprising PG. The PDO 30/70 enhances significantly the perception of Menthol flavour in terms of "Sweet" and "Sweet Aftertaste" compared to PG/VG 30/70. The "p" value for each attribute can be seen in the table below. The "p" value is less than 0.10 for both attributes.

TABLE 7

P value of pairwise comparison of different attributes in the PDO:VG in the ratio of 30:70. Fruit flavour - berry (PDO/VG 30/70 and PG/VG 30/70)

| | |
|---|---|
| First Impact | 0.54 |
| Vapor Volume | 0.85 |
| Overall Flavour | 0.59 |
| Sweet † | 0.069 |
| Tobacco | 0.11 |
| Mint/Menthol | 0.32 |
| Bitter | 0.96 |
| Apple | 0.75 |
| Pear | 0.86 |
| Pineapple | 0.99 |
| Coconut | 0.30 |
| Raspberry | 0.28 |
| Strawberry | 0.84 |
| Mixed Berries | 0.75 |
| Smoky | 0.15 |
| Woody | 0.37 |
| Coffee | 0.23 |
| Roasted | 0.93 |
| Off-Taste | 0.31 |
| Natural/Authentic | 0.63 |
| Cooling | 0.95 |
| Mouth/Nose/Throat Irritation | 0.91 |
| Impact | 0.33 |
| Overall Flavour Aftertaste | 0.97 |
| Sweet Aftertaste † | 0.10 |
| Mint Aftertaste | 0.46 |
| Cooling Aftertaste | 0.32 |
| Coating | 0.18 |
| Dryness | 0.76 |
| Overall Liking | 0.25 |

Overall, it can be seen that with the PG/VG in the solvent, some attributes are not well perceived like with PDO in the solvent at the same ratio 30/70 as significant lower mean scores is showed in comparison to the sample comprising PDO and glycerol in the same ratio. In addition, the "p" values reported in the tables for those specific attributes show that there is well recognized difference between both samples of solvent.

Noteworthy, the inventors of the present invention also found out that the solvent comprising PDO as claimed presently is not only stable upon heating (e.g. less than 250° C.) and have better thermal behaviour showing less thermal decomposition by-products compared to PG, PDO also seems to give nicotine a more basic environment ensuring a complete free base nicotine form.

Furthermore, when the ratio of PDO to glycerol is 3:7, the solvent gives surprisingly better flavouring properties than PG and glycerol. This special effect has not been observed in another ratio, for instance 2:3, 3:2, or 1:4.

The 1, 3-Propanediol (PDO) used in the present invention is commercially available provided from companies such as Laboratoires Xèrés and Naturacig under the product name of "vegetol". It is therefore foreseen that the PDOs provided by other companies can also be treated as equivalent.

The liquid composition as used herein contains solvent as described herein, wherein the solvent is glycerol-based (i.e. over 50% by weight). The liquid composition may further include elements such as nicotine, water, flavour, additives, acid, etc. For instance, the weight distribution of these elements can be for instance 0.05-10 wt. % of nicotine, 0-7.76% of acid, 0-10 wt. % of water, 0.7-20 wt. % of flavour, 50-90 wt. % of glycerol.

As an example, the combined amount of PDO and glycerol according to the present invention may be provided up to 79.95 wt. % based on the total weight of the solvent, the rest being made up of for instance 0.05 wt. % of nicotine and 20 wt. % of flavourant. In a second example, the combined amount of PDO and glycerol may be provided at 70 wt. % while the rest are made up with 10 wt. % nicotine and 20 wt. % flavourant.

It is furthermore disclosed herein that in embodiments where the composition of the present invention disclosed in FIGS. 1 to 6 does not comprise acid (in particular carboxylic acid) but comprise 5% of nicotine and flavourant (e.g. American tobacco or American menthol), the pH is 8.8 (American tobacco) and 9.8 (American menthol).

If the composition comprises acid (e.g. benzoic acid) with 5% of nicotine and flavourant (e.g. American tobacco or American menthol), 1:1 equimolar acid and nicotine, the pH is 5.1 (American tobacco) and 5.2 (American menthol) is used.

Figure 7:
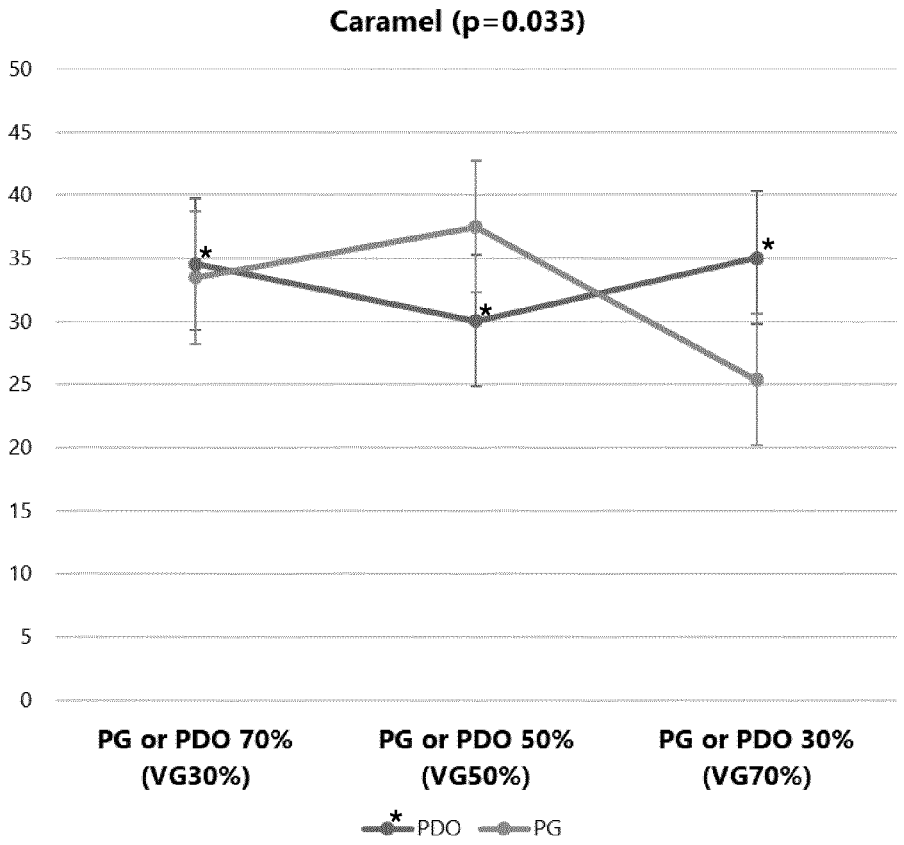
FIG. 7 shows the attribute mean scores of the perception of "caramel undertone" in tobacco flavour e-liquid with PDO and glycerol or PG in glycerol under three different ratios.
Figure 8:
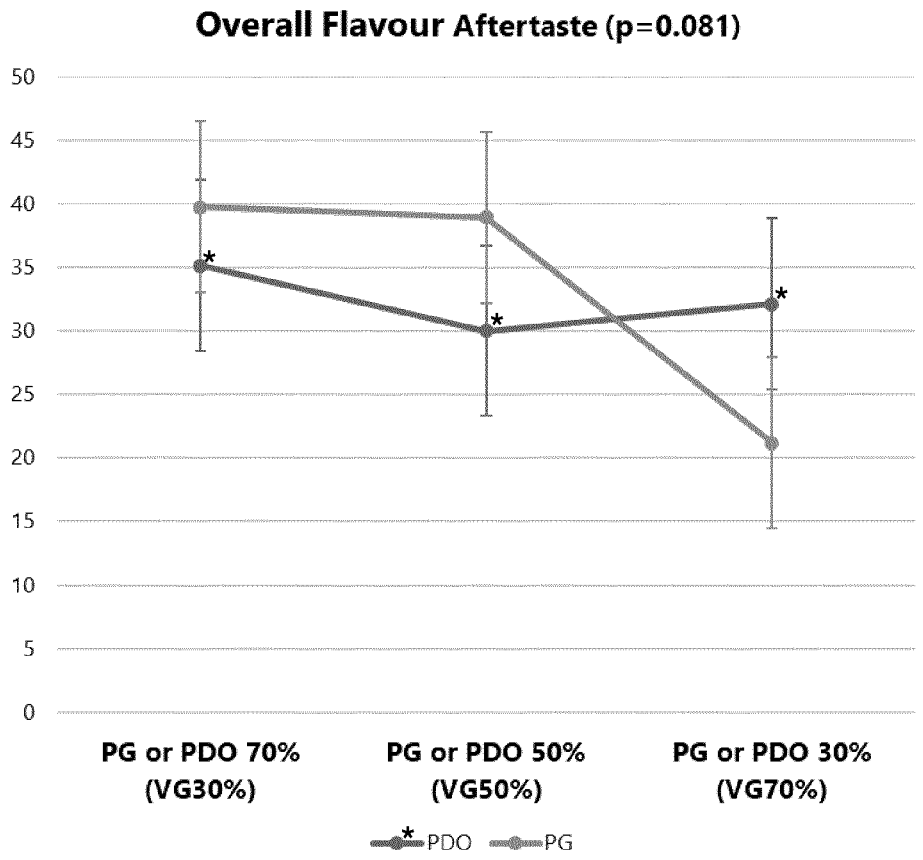
FIG. 8 shows the comparison of the attribute mean scores of the perception of "overall flavour aftertaste" in tobacco flavour e-liquid with PDO and glycerol or PG in glycerol under three different ratios.
Figure 9:
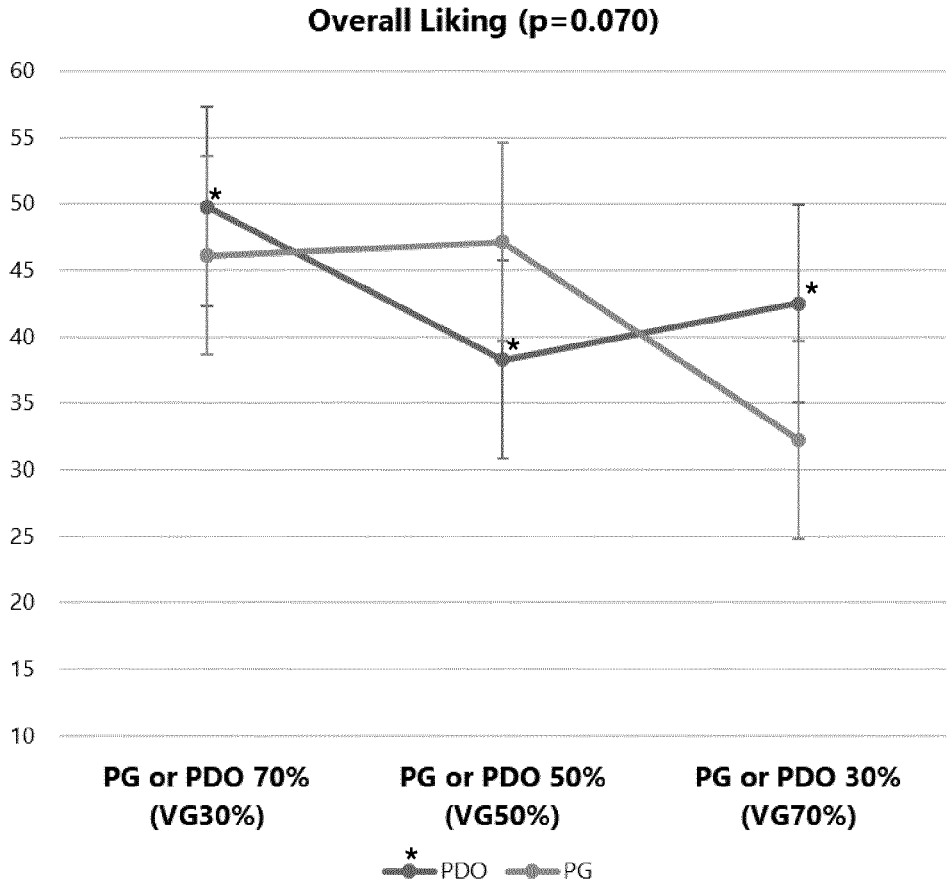
FIG. 9 shows the comparison of the attribute mean scores of the perception of "overall liking" for tobacco flavour e-liquid with PDO and glycerol or PG in glycerol under three different ratios.

FIG. 7 to FIG. 9 showed that PDO enhances significantly the perception of tobacco in terms of "caramel flavour", "overall flavour after taste" and "overall liking", only when the ratio between PDO and glycerol is provided at 3:7 (p value is significant e.g. less than 0.1).

For instance, across the three different attributes where the inventors looked into, namely "caramel flavour" (FIG. 7), "overall flavour after taste" (FIG. 8) and "overall liking" (FIG. 9), the sample comprising PG and glycerol provided at the ratio of 3:7 showed significant lower mean scores in comparison to the sample comprising PDO and glycerol in the same ratio. In other words, when providing a solvent comprising predominantly of glycerol (i.e. over 50% by weight) and that the ratio between PDO and glycerol was provided at 3:7, such solvent gave a better perception of tobacco flavour which include for instance after taste as well as stronger flavour in comparison to solvent comprising PG.

Figure 10:
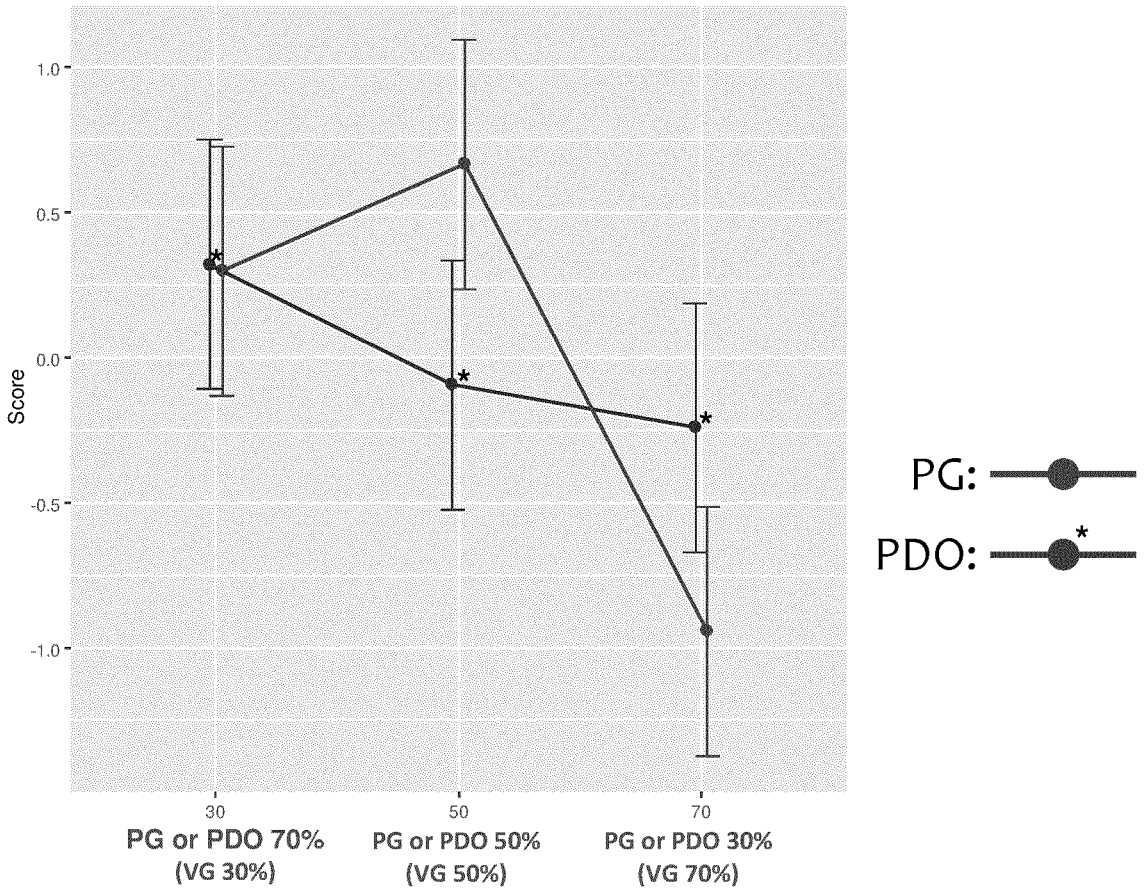
FIG. 10 shows the comparison of the attribute mean scores of the perception of "cooling sensation" in menthol flavour e-liquid with PDO and glycerol or PG in glycerol under three different ratios.
Figure 11:
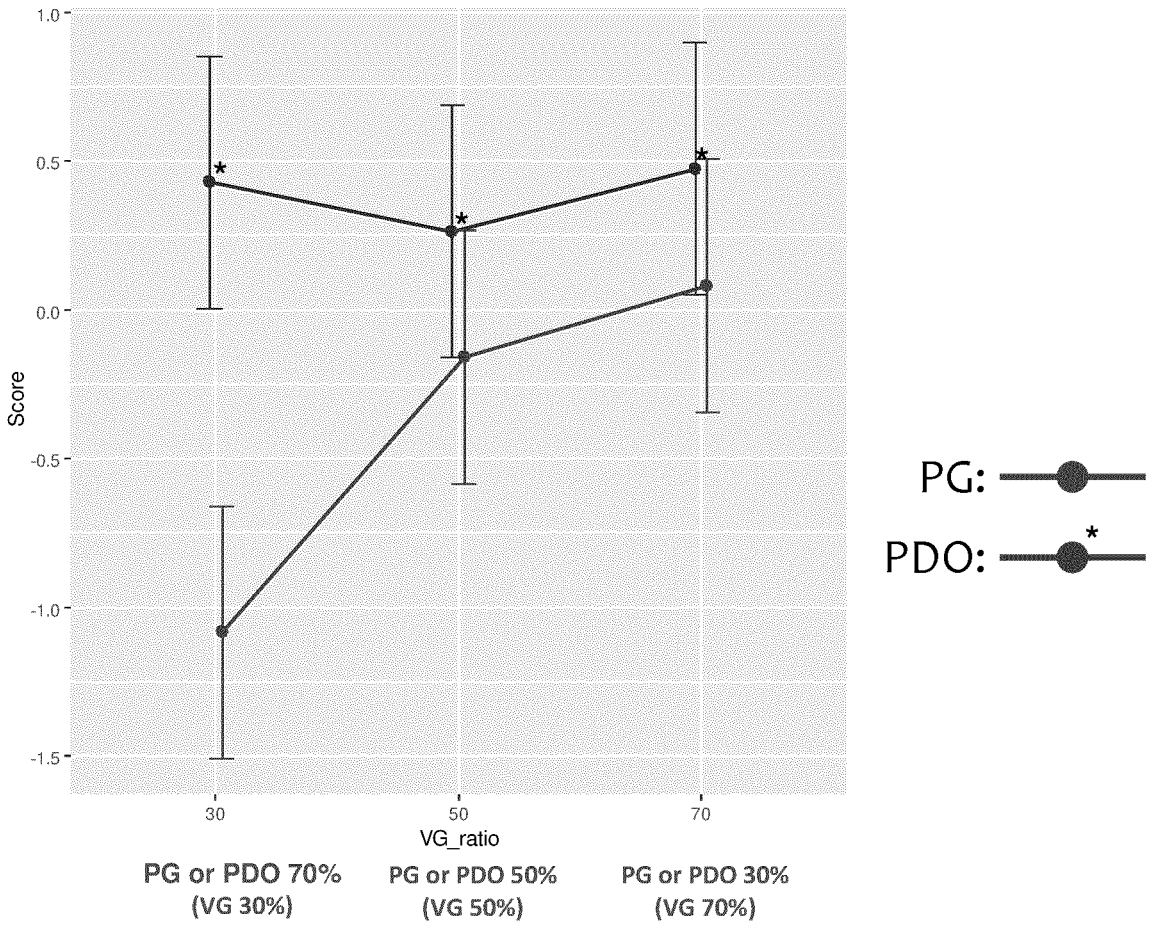
FIG. 11 shows the comparison of the attribute mean scores of the perception "dryness vs vapour volume" for menthol flavour e-liquid with PDO and glycerol or PG in glycerol under three different ratios.

FIGS. 10 and 11 showed the comparison of the attribute mean scores of menthol between solvents comprising PDO or PG under different ratios. Surprisingly, the results suggested that when the PDO and glycerol were provided in the ratio of 3:7, said solvents were capable of enhancing the vapour volume and lowering the perception of dryness. This attribute (perception to dryness and vapour volume) was particularly investigated as it is often sought after by users for the fact that this attribute relates to refreshing sensation.

In more detail, as can be seen in the FIG. 10, when the ratio of PDO and glycerol is provided at 3:7 (30% are PDO and 70% are glycerol), the "cooling sensation" decreased slightly compared to the other two ratios (i.e. 7:3 and 1:1). However, a significant dropped of the "cooling sensation" was observed in the sample of PG and glycerol having the ratio of 3:7. On another hand, when the attribute of "dryness vs vapour volume" was investigated, as demonstrated in the FIG. 11, samples containing PDO produced constantly higher mean scores across different ratios in comparison to the PG. This result proposed that glycerol-based solvent (i.e. over 50% by weight are glycerol) comprising a ratio of 3:7 of PDO and glycerol are particularly suitable for e-liquid providing cooling sensation and reduced dryness.

Figure 12:
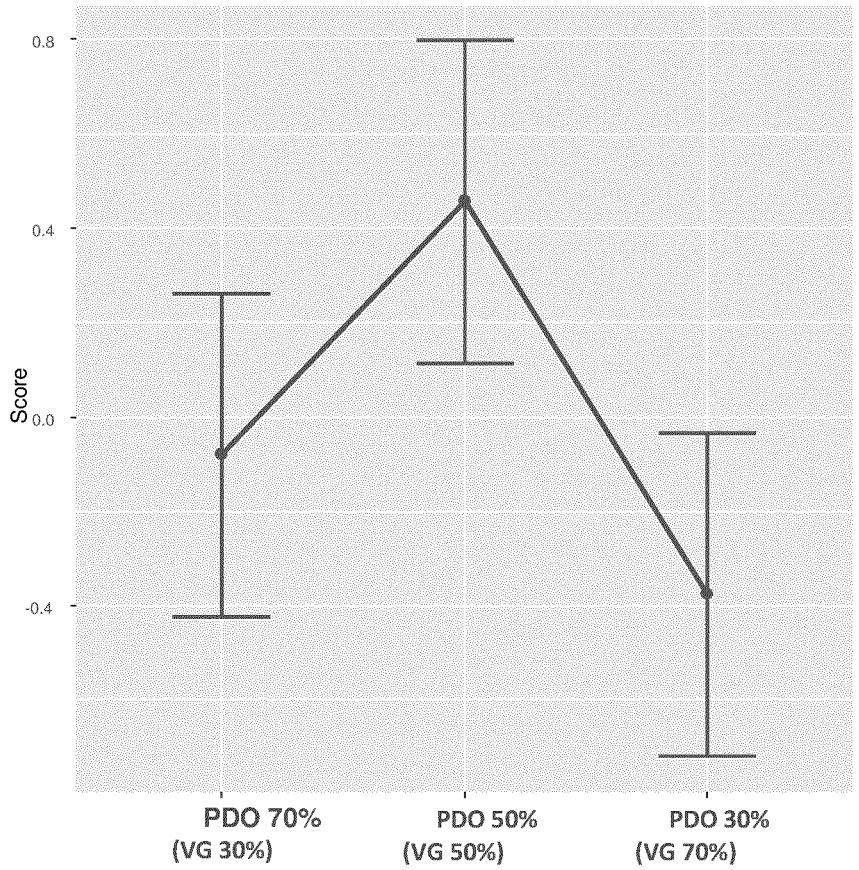
FIG. 12 shows the attribute mean scores of the perception of known "negative flavour notes", e.g.: smoky/coating/bitter in fruit (mixed berry) flavour e-liquids with PDO and glycerol or PG in glycerol under three different ratios.

FIG. 12 shows that PDO decreases the known negative attributes (e.g. smoky, coating and bitterness) for fruit flavour category, when the ratio of PDO and glycerol was provided at 3:7. This result clearly shows that solvent comprising lower percentage of PDO (3:7 for PDO: glycerol) is a more favourable candidate compared to other ratios.

Figure 13:
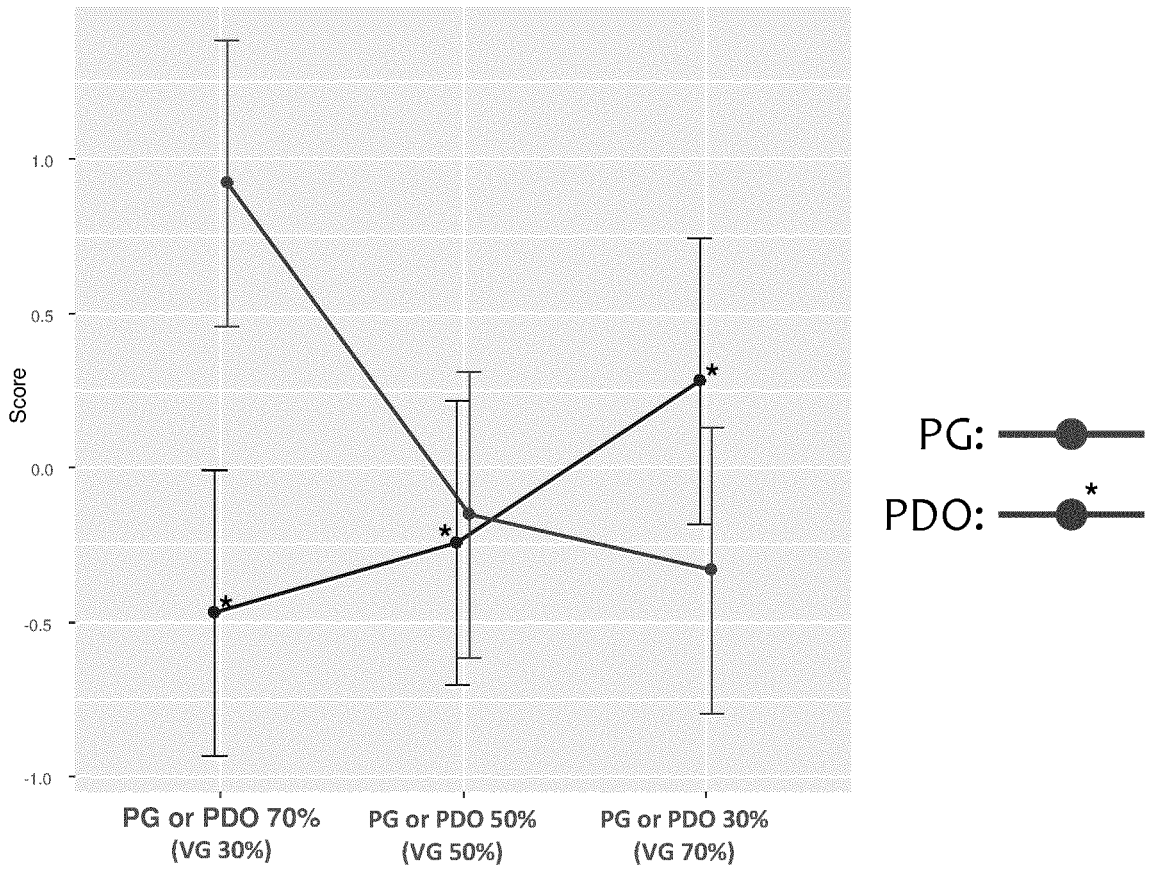
FIG. 13 shows the comparison of the attribute mean scores of the perception of "sweet/strawberry flavour" in fruit (mixed berry) flavour e-liquids with PDO and glycerol or PG in glycerol under three different ratios.

When the ratio of PDO and glycerol was provided at 3:7, the mean score for "sweet/strawberry" increased significantly, as can be seen in the FIG. 13 whereas the mean score of PG and glycerol, when the ratio was set at 3:7, decreased significantly. This shows that the solvent comprising PDO and glycerol is a better candidate in comparison of PG and glycerol when the solvent is provided at this ratio of 3:7.

Noteworthy, the inventors of the present invention also found out that the solvent comprising PDO as claimed presently is not only stable upon heating (e.g. less than 250° C.) and have better thermal behaviour showing less thermal decomposition by-products compared to PG, PDO also seems to give nicotine a more basic environment ensuring a complete free base nicotine form.

Furthermore, when the ratio of PDO to glycerol is 3:7, the solvent gives surprisingly better flavouring properties than PG and glycerol. This special effect has not been observed in another ratio, for instance 2:3, 3:2, or 1:4.

The 1, 3-Propanediol (PDO) used in the present invention is commercially available provided from companies such as Laboratoires Xèrés and Naturacig under the product name of "vegetol". It is therefore foreseen that the PDOs provided by other companies can also be treated as equivalent.

The liquid composition as used herein contains solvent as described herein, wherein the solvent is glycerol-based (i.e. over 50% by weight). The liquid composition may further include elements such as nicotine, water, flavour, additives, acid and etc. For instance, the weight distribution of these elements can be for instance 0.05-10 wt. % of nicotine, 0-7.76% of acid, 0-10 wt. % of water, 0.7-20 wt. % of flavour, 50-90 wt. % of glycerol.

As an example, the combined amount of PDO and glycerol according to the present invention may be provided up to 79.95 wt. % based on the total weight of the solvent, the rest being made up of for instance 0.05 wt. % of nicotine and 20 wt. % of flavourant. In a second example, the combined amount of PDO and glycerol may be provided at 70 wt. % while the rest are made up with 10 wt. % nicotine and 20 wt. % flavourant.

It is furthermore disclosed herein that in embodiments where the composition of the present invention does not comprise acid but comprise 5% of nicotine and flavourant (e.g. American tobacco or American menthol), the pH is 8.8 (American tobacco) and 9.8 (American menthol).

If the composition comprises acid (e.g. benzoic acid) with 5% of nicotine and flavourant (e.g. American tobacco or American menthol), 1:1 equimolar acid and nicotine, the pH is 5.1 (American tobacco) and 5.2 (American menthol) is used.

The invention claimed is:

1. A solvent for aerosol-generating material, wherein the solvent comprises 1, 3-Propanediol and glycerol, wherein the 1, 3-Propanediol is less than 50% by weight based on a total weight of the solvent, wherein a ratio of the 1, 3-Propanediol to the glycerol is 3:7.

2. A liquid composition comprising the solvent according to claim 1 and at least one of nicotine, flavourant, or water.

3. The liquid composition according to claim 2, wherein the solvent forms between 52.24% and 99.25% by weight of the composition.

4. The liquid composition according to claim 2, wherein, the composition further comprises between 0.04% and 7.76% by weight of one or a mixture of carboxylic acids based on a total weight of the composition.

5. The liquid composition according to claim 4, wherein the carboxylic acids include at least one acid selected from the group of Benzoic acid, Levulinic acid, D/L-Tartaric acid, Capric acid, Pyruvic acid, Citric acid, Fumaric acid, D/L-Lactic acid, D/L-Malic acid, Sorbic acid, Adipic acid, L-Aspartic acid, L-Glutamic acid, Succinic acid, Gluconic acid, Linoleic acid, Saccharic acid, 3,7 dimethyl-6-octenoic acid, 2-methyl pentanoic acid, trans-2-Hexenoic acid, Caprylic acid, Lauric acid, Stearic acid, Butyric acid, Linolenic acid, Malonic acid, Myristic acid, Oleic acid, Palmitic acid, Phenylacetic acid, Propionic acid, Valeric acid, Decanoic acid, Hexanoic acid, and Octanoic acid.

6. The liquid composition according to claim 4, wherein the liquid composition has a pH value in a range from 6.3 to 6.5.

7. The liquid composition according to claim 2, wherein the liquid composition has a pH value in a range from 5 to 9 and the composition contains no acid.

8. The liquid composition according to claim 2, wherein the liquid composition has a pH value in a range from 5.1 to 8.8 and the composition contains no acid.

9. The liquid composition according to claim 2, wherein the liquid composition has a pH value in a range from 8.8 to 9.8 and the composition contains no acid.

10. The liquid composition according to claim 2, wherein the composition is a gel, a foam, or a semi-solid matrix.

11. An aerosol generating article comprising the liquid composition according to claim 2.

12. A liquid composition comprising the solvent according to claim 1 and nicotine, wherein the nicotine forms at most 10% by weight based on a total weight of the composition.

13. A liquid composition comprising the solvent according to claim 1 and nicotine, wherein the nicotine forms at most 5% by weight based on a total weight of the composition.

14. A liquid composition comprising the solvent according to claim 1 and flavourant, wherein the flavourant forms between 0.7% and 20% by weight based on a total weight of the composition.

15. A liquid composition comprising the solvent according to claim 1 and flavourant, wherein the flavourant forms between 15% and 20% by weight based on a total weight of the composition.

16. An aerosol generating article comprising the solvent according to claim 1.

17. The aerosol generating article according to claim 16, wherein the article is any of an electronic cigarette, an electronic cigarette cartridge, or an e-cigarette liquid.

18. The aerosol-generating article according to claim 16, wherein the article is a heat-not-burn consumable product.

19. A liquid composition comprising between 52.24% and 99.25% by weight of a solvent for aerosol-generating material, 0.05% to 10% by weight of nicotine, between 0.7% and 20% by weight of flavourant, 0% to 10% by weight of water, and 0% to 7.76% by weight of one or a mixture of carboxylic acids, based on the total weight of the composition, wherein the solvent comprises 1, 3-Propanediol and glycerol, wherein the 1, 3-Propanediol is less than 50% by weight based on a total weight of the solvent, and a ratio of the 1, 3-Propanediol to the glycerol is 3:7.

20. An aerosol generating article comprising the liquid composition according to claim 19.

* * * * *